US008136934B2

(12) United States Patent
Snyder et al.

(10) Patent No.: US 8,136,934 B2
(45) Date of Patent: Mar. 20, 2012

(54) WASTE PHASE CHANGE INK RECYCLING

(75) Inventors: Trevor James Snyder, Newberg, OR (US); James Matthew Cunnington, Tualatin, OR (US)

(73) Assignee: Xerox Corporation, Norwalk, CT (US)

( * ) Notice: Subject to any disclaimer, the term of this patent is extended or adjusted under 35 U.S.C. 154(b) by 519 days.

(21) Appl. No.: 12/372,774

(22) Filed: Feb. 18, 2009

(65) Prior Publication Data

US 2010/0208018 A1 Aug. 19, 2010

(51) Int. Cl.
*B41J 2/18* (2006.01)

(52) U.S. Cl. ..... 347/89

(58) Field of Classification Search ..... 347/89, 347/84–85, 33, 35, 36, 29, 7
See application file for complete search history.

(56) References Cited

U.S. PATENT DOCUMENTS 4,491,433 A 1/1985 Shiurila et al.
7,048,353 B2 5/2006 Waller et al.
2005/0146569 A1 7/2005 Hoisington et al.
2005/0285917 A1 12/2005 Nichols et al.
2006/0244799 A1 11/2006 Sasa et al.
2007/0279465 A1 12/2007 Shindo

FOREIGN PATENT DOCUMENTS

WO 2005065294 7/2005
WO 2008013839 1/2008

OTHER PUBLICATIONS

European Search Report corresponding to European Patent Application 10153762.9, European Patent Office, Rijswijk, Netherlands, Jun. 7, 2010 (7 pages).

*Primary Examiner* — Kristal Feggins
(74) *Attorney, Agent, or Firm* — Maginot, Moore & Beck, LLP

(57) ABSTRACT

A printhead for use in an imaging device includes a reservoir configured to receive ink from an ink source. An aperture plate includes a plurality of ink jet apertures at a first location in the aperture plate and a plurality of recycling apertures at a second location in the aperture plate. The printhead includes a plurality of ink jets, each ink jet being configured to receive ink from the reservoir and to reject ink through one of the ink jet apertures in the aperture plate, and a plurality of channels, each channel being configured to fluidly couple one of the recycling apertures in the aperture plate to the reservoir. A pressure source is coupled to the reservoir that is configured to generate a pressure in the reservoir.

20 Claims, 6 Drawing Sheets

WASTE PHASE CHANGE INK RECYCLING

TECHNICAL FIELD

This disclosure relates generally to an ink jet imaging device, and, in particular, to the handling of waste ink in such ink jet imaging devices.

BACKGROUND

In general, ink jet printing machines or printers include at least one printhead that ejects drops or jets of liquid ink onto a recording or image forming media. A phase change ink jet printer employs phase change inks that are solid at ambient temperature, but transition to a liquid phase at an elevated temperature. The molten ink may then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In various modes of operation, ink may be purged from the printheads to ensure proper operation of the printhead. When a solid ink printer is initially turned on, the solid ink is melted or remelted and purged through the printhead to clear air bubbles and prime each jet. The word "printer" as used herein encompasses any apparatus, such as digital copier, bookmaking machine, facsimile machine, multi-function machine, or the like that performs a print outputting function for any purpose. When ink is purged through the printhead, the ink flows down and off the face of the printhead typically to a waste ink tray or container positioned below the printhead where the waste ink is allowed to cool and re-solidify. The waste ink collection container is typically positioned in a location conveniently accessible so that the container may be removed and the waste ink discarded.

SUMMARY

As an alternative to discarding or disposing of waste phase change ink that is collected in a phase change ink imaging device, printheads may be provided with recycling apertures and channels for recycling or recirculating waste ink through the printhead. In particular, a printhead for use in an imaging device includes a reservoir configured to receive ink from an ink source. An aperture plate includes a plurality of ink jet apertures at a first location in the aperture plate and a plurality of recycling apertures at a second location in the aperture plate. The printhead includes a plurality of ink jets, each ink jet being configured to receive ink from the reservoir and to eject ink through one of the ink jet apertures in the aperture plate, and a plurality of channels, each channel being configured to fluidly couple one of the recycling apertures in the aperture plate to the reservoir. A pressure source is coupled to the reservoir that is configured to generate a pressure in the reservoir.

In another embodiment, a printhead for use in an imaging device includes a reservoir configured to receive ink from an ink source; an aperture plate including a plurality of ink jet apertures; and a jet stack. The jet stack includes a plurality of ink jets at a first location in the jet stack. The jet stack is configured to receive ink from the reservoir and communicate the ink to the plurality of ink jets. The plurality of ink jets is configured to eject ink through the plurality of ink jet apertures in the aperture plate. At least one recycle pocket is formed at a second location in the jet stack and is configured to capture waste ink emitted by the plurality of ink jets through the plurality of ink jet apertures. A plurality of recycling apertures is formed in a wall of at least one recycle pocket, and a plurality of recycling channels extends between and fluidly connects the plurality of recycling apertures to the reservoir. A negative pressure source is configured to apply a negative pressure to the reservoir to draw waste ink captured by the at least one recycle pocket through the plurality of recycling apertures, associated recycling channels, and into the reservoir.

In yet another embodiment, an imaging device comprises an ink source configured to supply melted phase change ink, and at least one printhead. The printhead includes a reservoir configured to receive melted phase change ink from the ink source; and an aperture plate including a plurality of ink jet apertures at a first location in the aperture plate and a plurality of recycling apertures at a second location in the aperture plate. A jet stack includes a plurality of ink jets and a plurality of recycling channels. The jet stack is configured to receive ink from the reservoir and communicate the ink to the plurality of ink jets. The plurality of ink jets is configured to eject ink through the plurality of ink jet apertures in the aperture plate. The plurality of recycling channels extends between and fluidly connects the plurality of recycling apertures to the reservoir. A recycling aperture cover plate is positioned on the aperture plate at the second location and is configured to capture waste ink emitted by the plurality of ink jets through the plurality of ink jet apertures and hold the waste ink at the plurality of recycling apertures. A negative pressure source is configured to apply a negative pressure to the reservoir to draw waste ink captured by the cover plate through the plurality of recycling apertures, associated recycling channels, and into the reservoir.

BRIEF DESCRIPTION OF THE DRAWINGS

The foregoing aspects and other features of the printhead with ink recycling functionality are explained in the following description, taken in connection with the accompanying drawings, wherein.

DETAILED DESCRIPTION

Figure 1:
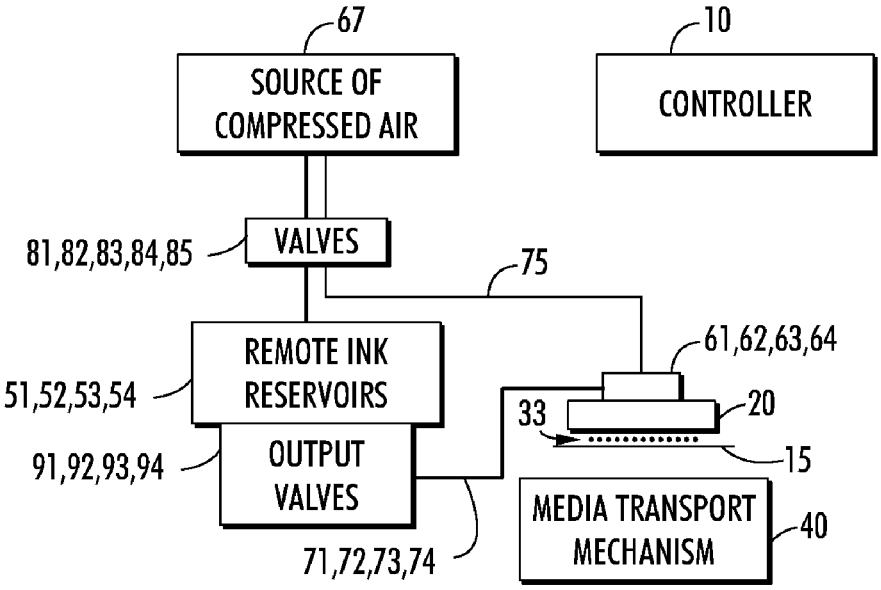
FIG. 1 is a schematic block diagram of an embodiment of an ink jet printing apparatus that includes on-board ink reservoirs.

For a general understanding of the present embodiments, reference is made to the drawings. In the drawings, like reference numerals have been used throughout to designate like elements.

As used herein, the term "imaging device" generally refers to a device for applying an image to print media. "Print media" may be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

Figure 2:
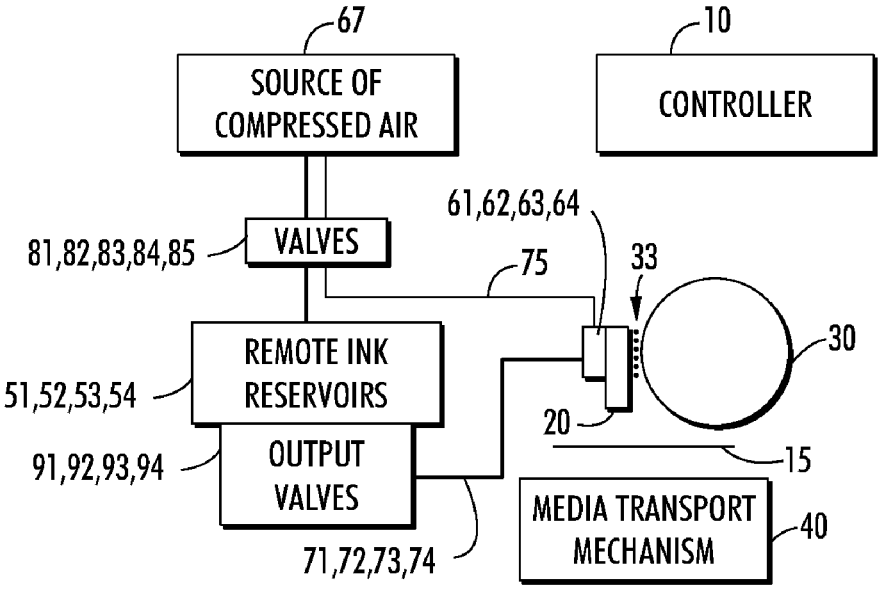
FIG. 2 is a schematic block diagram of another embodiment of an ink jet printing apparatus that includes on-board ink reservoirs.

FIGS. 1 and 2 are schematic block diagrams of an embodiment of an ink jet printing apparatus that includes a controller 10 and a printhead 20 that may include a plurality of drop emitting drop generators for emitting drops of ink 33 either directly onto a print output medium 15 or onto an intermediate transfer surface 30. A print output medium transport mechanism 40 may move the print output medium relative to the printhead 20. The printhead 20 receives ink from a plurality of on-board ink reservoirs 61, 62, 63, 64 which are attached to the printhead 20. The on-board ink reservoirs 61-64 respectively receive ink from a plurality of remote ink containers 51, 52, 53, 54 via respective ink supply channels 71, 72, 73, 74.

Although not depicted in FIG. 1 or 2, ink jet printing apparatus includes an ink delivery system for supplying ink to the remote ink containers 51-54. In one embodiment, the ink jet printing apparatus is a phase change ink imaging device. Accordingly, the ink delivery system comprises a phase change ink delivery system that has at least one source of at least one color of phase change ink in solid form. The phase change ink delivery system also includes a melting and control apparatus (not shown) for melting the solid form of the phase change ink into a liquid form and delivering the melted ink to the appropriate remote ink container.

The remote ink containers 51-54 are configured to communicate melted phase change ink held therein to the on-board ink reservoirs 61-64. In one embodiment, the remote ink containers 51-54 may be selectively pressurized, for example by compressed air that is provided by a source of compressed air 67 via a plurality of valves 81, 82, 83, 84. The flow of ink from the remote containers 51-54 to the on-board reservoirs 61-64 may be under pressure or by gravity, for example. Output valves 91, 92, 93, 94 may be provided to control the flow of ink to the on-board ink reservoirs 61-64.

The on-board ink reservoirs 61-64 may also be selectively pressurized, for example by selectively pressurizing the remote ink containers 51-54 and pressurizing an air channel 75 via a valve 85. Alternatively, the ink supply channels 71-74 may be closed, for example by closing the output valves 91-94, and the air channel 75 may be pressurized. The on-board ink reservoirs 61-64 may be pressurized to perform a cleaning or purging operation on the printhead 20, for example. The on-board ink reservoirs 61-64 and the remote ink containers 51-54 may be configured to contain melted solid ink and may be heated. The ink supply channels 71-74 and the air channel 75 may also be heated.

The on-board ink reservoirs 61-64 are vented to atmosphere during normal printing operation, for example by controlling the valve 85 to vent the air channel 75 to atmosphere. The on-board ink reservoirs 61-64 may also be vented to atmosphere during non-pressurizing transfer of ink from the remote ink containers 51-54 (i.e., when ink is transferred without pressurizing the on-board ink reservoirs 61-64).

FIG. 2 is a schematic block diagram of an embodiment of an ink jet printing apparatus that is similar to the embodiment of FIG. 1, and includes a transfer drum 30 for receiving the drops emitted by the printhead 20. A print output media transport mechanism 40 engages an output print medium 15 against the transfer drum 30 to cause the image printed on the transfer drum to be transferred to the print output medium 15.

Figure 3:
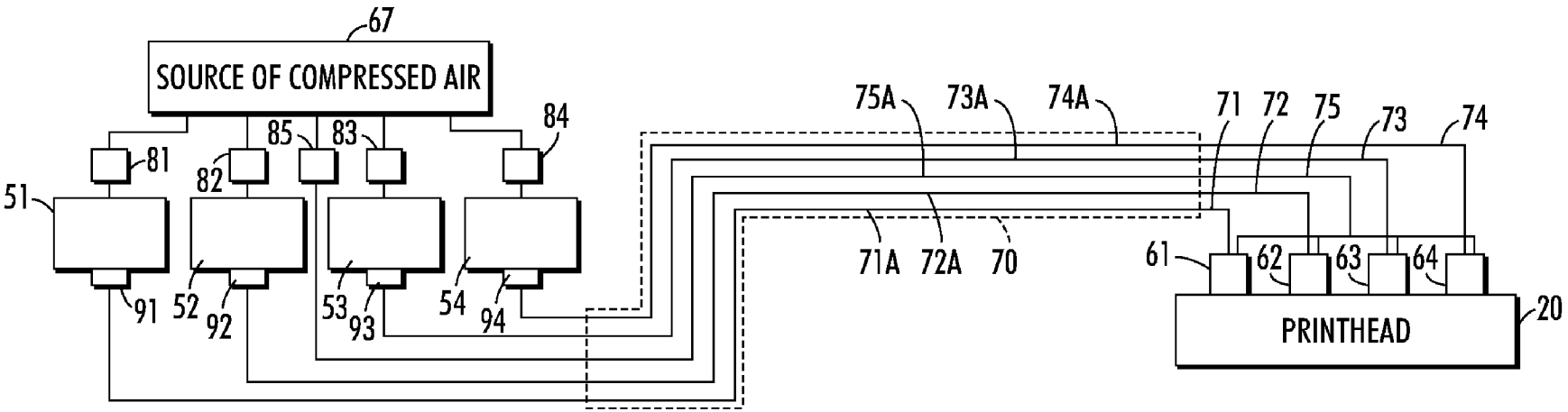
FIG. 3 is a schematic block diagram of an embodiment of ink delivery components of the ink jet printing apparatus of FIGS. 1 and 2.

As schematically depicted in FIG. 3, a portion of the ink supply channels 71-74 and the air channel 75 may be implemented as conduits 71A, 72A, 73A, 74A, 75A in a multi-conduit cable 70.

Figure 4:
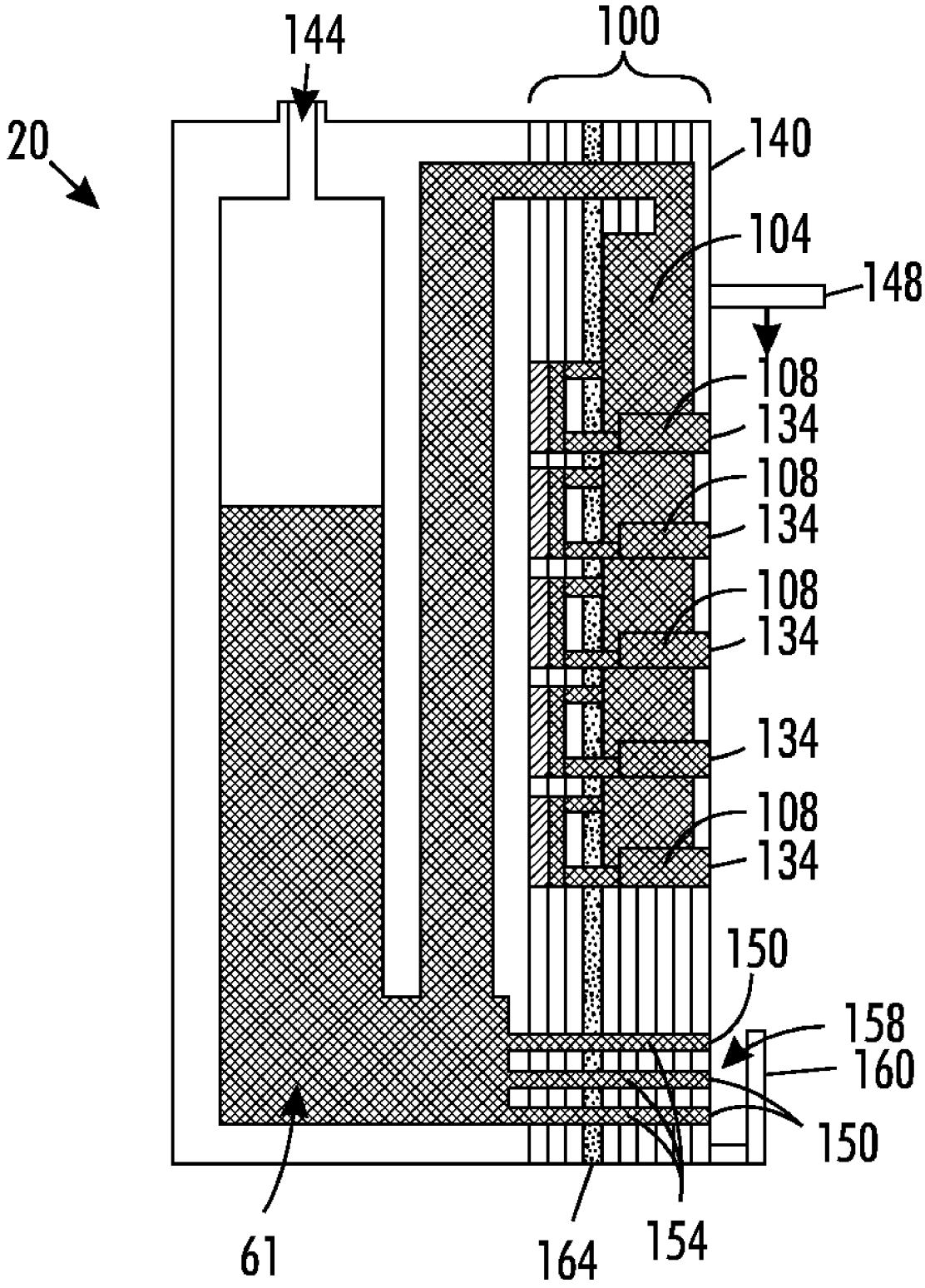
FIG. 4 is a simplified side cross-sectional view of an embodiment of a printhead that includes recycling apertures and channels.

Once pressurized ink reaches a printhead via an ink supply channel, it is collected in the on-board reservoir. The on-board reservoir is configured to communicate the ink to a jet stack that includes a plurality of ink jets for ejecting the ink onto a print medium (FIG. 1) or an intermediate transfer member such as transfer drum 30 (FIG. 2). FIG. 4 shows an embodiment of a printhead 20 including at least one on-board reservoir 61. The jet stack 100 can be formed in many ways, but in this example, it is formed of multiple laminated sheets or plates, such as stainless steel plates. Cavities etched into each plate align to form channels and passageways that define the ink jets for the printhead. Larger cavities align to form larger passageways that run the length of the jet stack. These larger passageways are ink manifolds 104 arranged to supply ink to the ink jets 108. The plates of the jet stack 100 are stacked in face-to-face registration with one another and then brazed or otherwise adhered together to form a mechanically unitary and operational jet stack.

Figure 5:
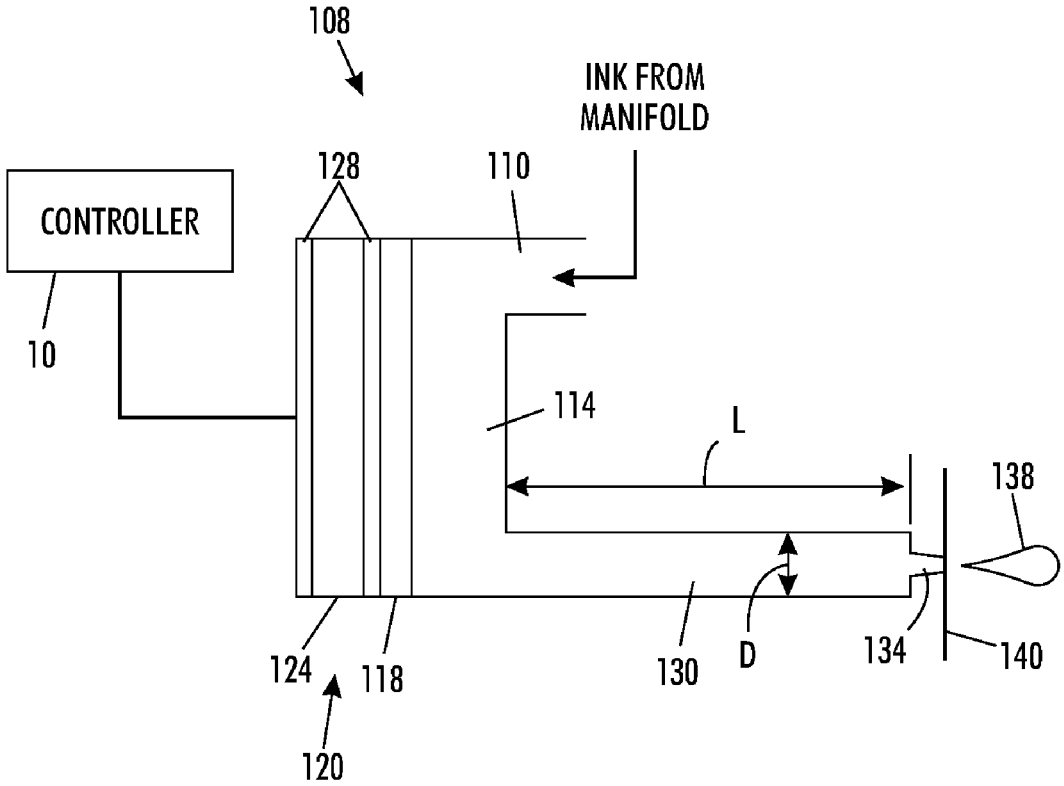
FIG. 5 is a schematic elevational view of an ink jet.

FIG. 5 shows a schematic elevational view of an embodiment of an ink jet 108 that may be formed by the plurality of plates of a jet stack 100. The drop generator 108 includes an inlet channel 110 that receives ink from a manifold, reservoir or other ink containing structure. The ink flows from the inlet channel 110 into a pressure chamber 114, also referred to as a body chamber, that is bounded on one side, for example, by a flexible diaphragm 118. An electromechanical transducer 120 is attached to the flexible diaphragm 118 overlying the body chamber 114, for example. The electromechanical transducer 120 can be a piezoelectric transducer that includes a piezo element 124 disposed for example between electrodes 128 that receive drop firing and non-firing signals from the controller 10. Actuation of the electromechanical transducer 120 causes ink to flow from the pressure chamber 114 to a drop forming outlet channel 130. The outlet channel includes an aperture 134 formed in the jet stack aperture plate 140 through which ink drops 138 are emitted. As mentioned, the ink may be melted phase change ink. The electromechanical transducer 120 may be a piezoelectric transducer that is operated in a bending mode, for example.

The combined length of the outlet channel spans the plates of the jet stack that form the drop generators and ink manifolds. In one embodiment, the outlet channel 130 may have an overall length L of approximately 75.0 mil. The diameter D of the outlet channel may be between approximately 8.0 mil and approximately 20.0 mil. The aperture 134 has a length that corresponds to the thickness of the aperture plate 140 which may be approximately 1.5 mil, and the aperture may have a diameter of approximately 38-42 μm. During operation, capillary action causes ink from the on-board printhead reservoir 61 to fill the ink manifolds, inlet channels, pressure chambers, and outlet channels of the ink jets 108 and form a meniscus (not shown) at each aperture prior to being expelled from the apertures in the form of a droplet. The size of the apertures and channels of the ink jets enable the ink meniscus to be pinned at the aperture until the ink jet is actuated while preventing air from entering the printhead via the apertures.

As mentioned, in order to purge ink from the printhead, a positive pressure may be applied to the melted phase change ink in the on-board printhead reservoir 61 using the pressure source 67 through an opening, or vent, 144 causing the ink in the reservoir 61 to discharge through the plurality of ink jets 108 in the jet stack 100 and out of the corresponding plurality of ink apertures 134 in the aperture plate 140. A scraper or wiper blade 148 may also be drawn across the aperture plate 140 to squeegee away any excess liquid phase change ink, as well as any paper, dust or other debris that has collected on the aperture plate 140. In previously known imaging devices, the waste ink wiped-off or otherwise removed from the face of the printhead (typically, still in liquid from) was caught by a gutter which ultimately channeled or otherwise directed it toward a waste ink collection container where, e.g., it was allowed to cool and re-solidify. The container was then removed for disposal or emptied.

As an alternative to collecting and disposing of waste phase change ink generated by the printheads of an imaging device, the printhead of FIG. 4 has been provided with a second plurality of apertures, referred to herein as recycling apertures 150, in the aperture plate. Recycling apertures 150 comprise openings formed in the aperture plate 140 that may be similar, although not necessarily, in size and shape to the ink jet apertures 134. Each recycling aperture 150 is fluidly connected to the on-board printhead reservoir 61 by a corresponding recycling channel 154 that extends from the recycling apertures 150 back through the plates that form the jet stack 100 and opens up into the on-board reservoir 61. Waste ink emitted through the ink jet apertures 134 of the printhead may be collected in one or more pockets or cavities 158 in front of the recycling apertures formed by, for example, a recycling aperture cover plate 160. A small negative pressure may then be applied to the on-board reservoir via the vent 144, for example, to draw or suck the waste ink collected in the one or more pockets 158 of the aperture cover 160 through the recycling apertures 150 and back into the on-board reservoir.

Figure 6:
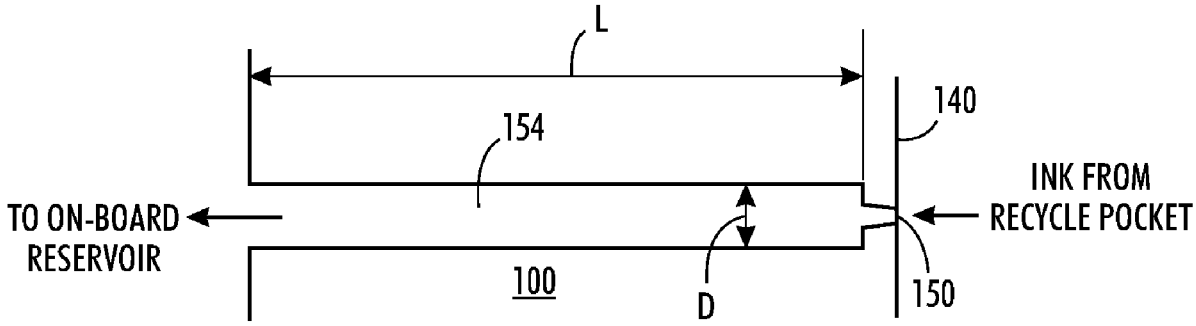
FIG. 6 is a schematic elevational view of a recycling aperture and channel.
Figure 7:
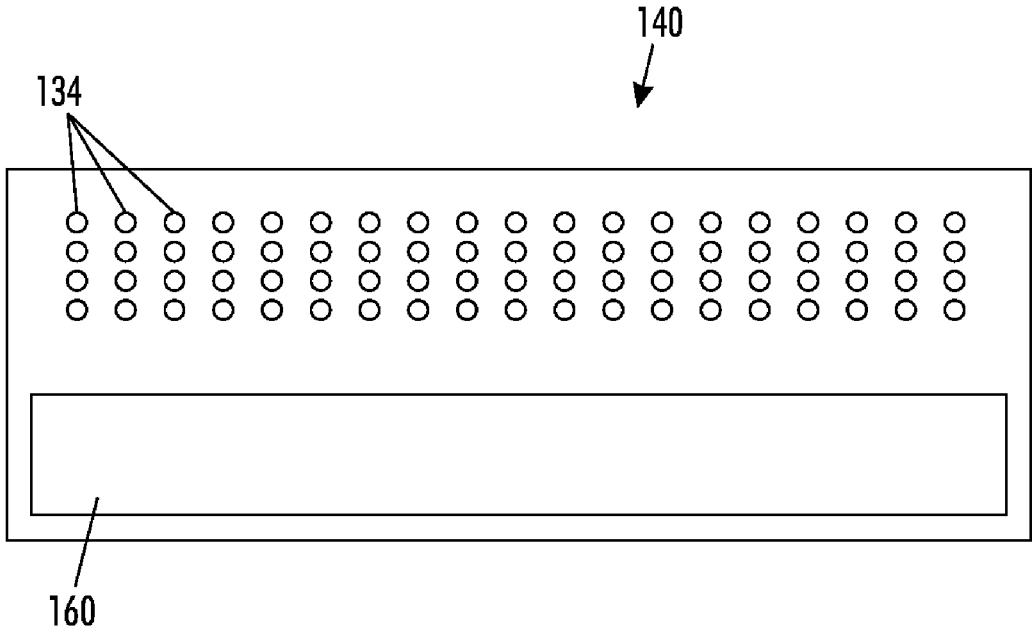
FIG. 7 is a front elevational view of an aperture plate showing a recycling aperture cover plate.
Figure 8:
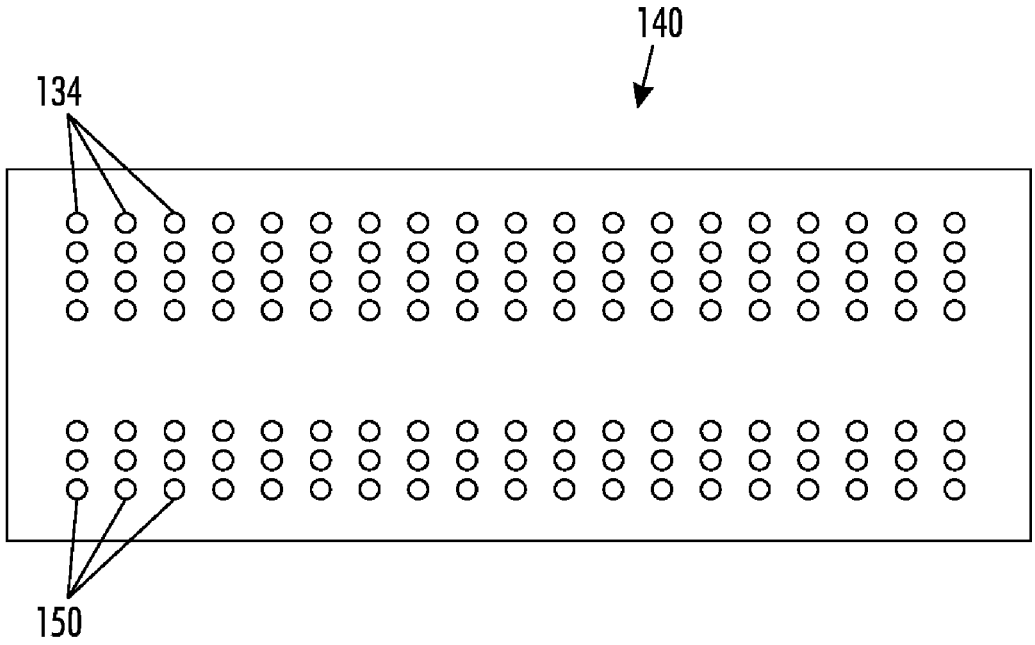
FIG. 8 is a front elevational view of the aperture plate of FIG. 7 with the cover plate removed.

For example, FIGS. 7 and 8 show an embodiment of an aperture plate 140 showing a plurality of ink jet apertures 134 through which ink jets 108 eject ink onto an ink receiver, such as a transfer surface or print media. FIG. 7 shows the aperture plate with the recycling aperture cover plate, and FIG. 8 shows the aperture plate of FIG. 7 with the cover plate removed to show the recycling apertures. In the embodiment of FIGS. 4-8, the aperture plate 140 includes a plurality of recycling apertures 150 that are positioned in the aperture plate 140 below the ink jet apertures 134. As explained below, recycling apertures may be positioned at other suitable locations on the aperture plate, such as above the ink apertures. Recycling apertures may have any suitable number, arrangement, and/or density. For example, the recycling apertures may be arranged in a linear grid-like array as depicted in FIG. 8, or may have, for example, a staggered arrangement (not shown). The number and density of recycling apertures incorporated into a printhead may be any number of apertures that enables the waste ink captured in the recycling pockets or cavities to be recirculated through the on-board reservoir. The term density in regards to recycling apertures refers to the number of apertures per unit area. In the embodiment of FIG. 8, the recycling apertures are formed in the aperture plate 140 at a density that is approximately 20 apertures per square inch.

As mentioned, the recycling apertures 150 comprise openings through the aperture plate 140 that enable waste ink to be drawn back into the on-board reservoir of the printhead. In the embodiment of FIGS. 4-8, the recycling apertures have a circular shape. The openings that define the recycling apertures, however, may have any suitable cross-sectional shape. The recycling apertures 150 may be substantially the same size as the ink jet apertures. Accordingly, in one embodiment, the circular recycling apertures may each have a diameter of approximately 38-44 μm. The recycling apertures 150, however, may have any suitable size and may be larger or smaller than the ink jet apertures 134 in the aperture plate 140. For example, the recycling aperture could be composed of one single long rectangular aperture.

With reference now to FIGS. 4 and 6, each recycling aperture 150 is fluidly connected to the on-board printhead reservoir 61 by a corresponding recycling channel 154 that extends from the recycling apertures 150 back through the plates that form the jet stack 100 and opens up into the on-board reservoir 61. Each recycling channel 154 is defined by openings in the plates of the printhead jet stack 100 that align to form the respective recycling channels 154. In one embodiment, the openings in each plate of the jet stack 100 that define the recycling channels 154 are substantially the same size and shape as the openings that define the ink jet outlet channels 130. The recycling channel plate openings, however, may be independent of the corresponding ink jet openings and thus may have any suitable size and shape. In general, the openings in the jet stack 100 that define the recycling channels 164 may be circular. Alternatively, the openings that define the channels 154 may have non-circular shapes, such as oval or square shapes. Moreover, the openings that define the recycling channels 154 may each be of the same or different sizes. For example, the openings in the plates may have different sizes so that the channel 154 grows progressively larger as it extends from the aperture 150 toward the on-board reservoir 61.

The recycling channels each have a length L from the recycling aperture 150 to the on-board reservoir 61 that corresponds substantially to the overall thickness of the jet stack 100 through which the channels are formed. Thus, in one embodiment, the recycling channels 154 may have an overall length L of approximately 75.0 mil. The diameter D of the recycling channel may be the substantially the same as the diameter of the outlet channel of the ink jets, and thus may be between approximately 8.0 mil and approximately 20.0 mil. The recycling channels, however, may have any suitable length and/or diameter.

In the embodiment of FIG. 4, waste ink emitted by the ink jets 108 of the printhead is collected in a pocket or cavity 158 on the aperture plate 140 in front of the recycling apertures 150 by a recycling aperture cover plate 160. The cover plate 160 may be formed of, for example, stainless steel or aluminum, although any suitable material may be used, and may be secured to the aperture plate 140 in any suitable manner. The aperture plate 140 forms one or more cavities or pockets 158 in front of the recycling apertures 150 that enable the recycling apertures 150 to be submerged in waste ink when the waste ink is collected by the cover plate 160. The recycle pockets 158 formed by the cover plate may be capable of capturing and holding any suitable amount of waste ink that is emitted by ink jets of the printhead. During purging operations, about 10 grams of ink may be forced through the ink jets of printhead. Because physical space is limited between the aperture plate and the image receiving surface, e.g., transfer drum, the recycle pockets 158 are generally capable of holding small amounts of waste ink which can limit the amount of purged ink that may be generated during a purge cycle. Therefore, numerous smaller purges may be utilized so that the recycle pockets 158 do not overfill with ink causing ink to escape the pockets and drip down onto interior components of an imaging device.

Capillary forces maintain the ink meniscus at the recycling apertures 150 while preventing air from being drawn into the printhead via the recycling apertures 150 when the aperture plate 140 is not wetted with ink. Tests have shown, however, that when an aperture is wetted by ink, ink may flow into the aperture. Therefore, in one embodiment, in order to draw ink into the printhead reservoir via the recycle apertures, the recycle apertures 150 are wetted by the waste ink captured in the recycle pockets 158 in front of the recycle apertures 150, and a small negative pressure is then applied to the on-board reservoir 61 that draws or sucks the ink collected in the pocket 158 or cavity through the wetted recycling apertures 150 and corresponding recycling channels 154 and into the on-board reservoir 61. As used herein, waste ink refers to ink that has passed through a printhead of an imaging device that has not been deposited onto a print substrate. For example, waste ink includes ink that has been purged or flushed through a printhead and ink that has collected on the nozzle plate of printheads during imaging operations.

In one embodiment, a negative pressure, or vacuum, may be applied to the ink in the on-board printhead reservoir 61 using, for example, a pressure source, such as a vacuum generator, through an opening, or vent, 144 in the on-board reservoir 61. The vent 144 through which the negative pressure is introduced into the on-board printhead reservoir 61 may be the same vent through which the positive pressure is introduced for purging operations. Accordingly, the pressure source 67 may be a bi-directional pressure source, vacuum source, or air pump that is configured to supply both positive and negative pressure to the on-board printhead reservoir 61. Separate pressure sources, however, may be used to introduce the positive and negative pressures into the on-board printhead reservoir. The negative pressure applied to the ink in the on-board reservoir 61 may have any suitable magnitude that enables the waste ink to be drawn through the recycle apertures and channels and into the on-board reservoir.

The small size of the recycle apertures 150 enables the recycle apertures 150 to act as a coarse filter to remove any large particles, such as dust and debris, from the waste ink as the waste ink is drawn into the printhead. The printhead jet stack 100 may include a filter plate 164 that filters the incoming ink from the on-board reservoir 61 prior to reaching the ink jets. The filter plate 164 may be used to filter the recycled ink drawn in through the recycle apertures. The printhead may be provided with additional or alternative filters at one or more locations in the printhead to filter the recycled ink.

Figure 9:
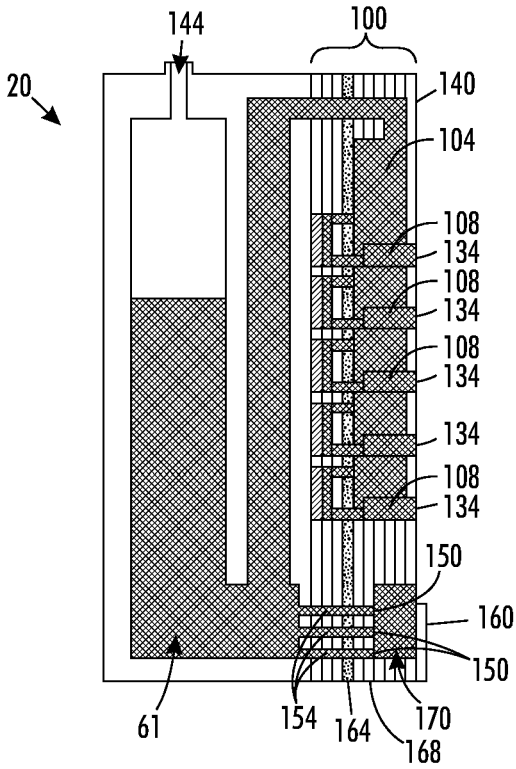
FIG. 9 is a simplified side cross-sectional view of another embodiment of a printhead that includes recycling apertures and channels.
Figure 10:
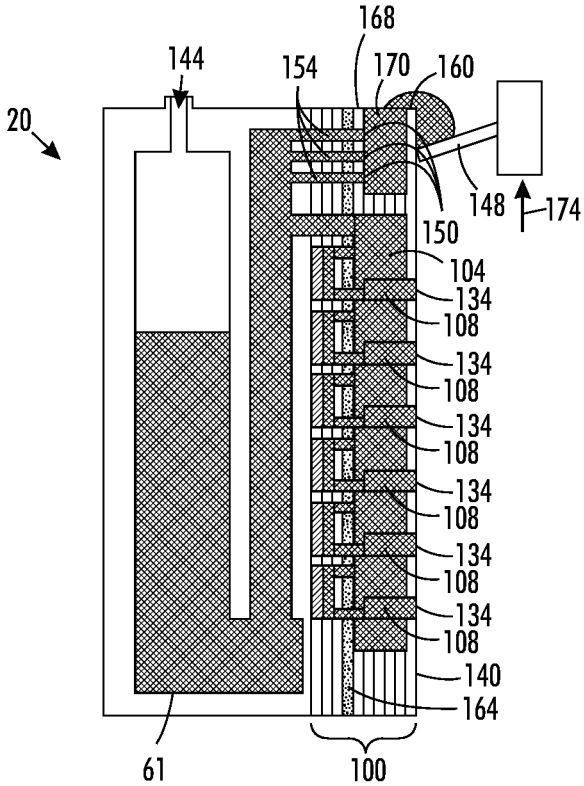
FIG. 10 is a simplified side cross-sectional view of yet another embodiment of a printhead that includes recycling apertures and channels.

Recycling apertures 150 may be incorporated into the printhead at other locations to recycle ink. FIGS. 9 and 10 show alternative embodiments of a printhead that includes recycling apertures and channels for recycling waste ink. In the embodiment of FIG. 9, the recycling apertures 150 are formed in one of the internal plates 168 that form the printhead jet stack, referred to herein as a recycle plate 168, at the bottom of the jet stack 100. Large openings may be formed in the plates in front of the recycle plate 168 to form an internal recycle pocket 170 in front of the recycling apertures 150 in the recycle plate 168. The front plate 160 may be the aperture plate or the printhead may include a front plate 160, similar to the aperture cover plate above, that collects the waste ink emitted from the ink jet apertures 134 and acts as a front wall for the internal recycle pocket 170. The use of an internal recycle pocket 170 enables a larger waste ink mass to be collected for recycling as opposed to recycle pockets 158 formed on the aperture plate 140 (FIG. 4). Similar to the embodiment of FIG. 4, in order to draw ink into the printhead reservoir 61 via the recycle apertures 150, the recycle apertures 150 are wetted by the waste ink captured in the internal recycle pocket 170 in front of the recycle apertures 150, and a small negative pressure is then applied to the on-board reservoir 61 via a vent 144 that draws or sucks the ink collected in the pocket or cavity 170 through the wetted recycling apertures 150 and corresponding recycling channels 154 and into the on-board reservoir 61.

FIG. 10 shows an embodiment of a waste ink recycling system in which the recycling apertures 150 are incorporated into the printhead above the ink jet apertures 134. In the embodiment of FIG. 10, the recycling apertures 150 are formed in an internal plate, or recycle plate 168, of the jet stack 100 at the top of the jet stack. Larger openings may be formed in the plates in front of the recycle plate 168 to form an internal recycle pocket 170. In the embodiment of FIG. 10, the aperture plate 140 may be used as a front wall 160 for the recycle pocket 170 that collects the waste ink emitted from the ink jet apertures 134. Because the recycle pocket 170 is positioned at the top of the jet stack 100, an apparatus such as a scraper or wiper blade 148 may be drawn upwardly across (e.g., in the direction indicated by the arrow 174) the aperture plate 140 to move waste ink to the top of the printhead and into the internal recycle pocket 170. When using recycle apertures positioned at the top of the printhead, the waste ink may be drawn or fed back into the on-board reservoir using negative pressure, as described above, gravity or a combination of both.

In the embodiments described above, the surface energy of the surface of the aperture plate may be modified to further enhance the ability of the printhead to recycle ink. As is known in the art, surface energy refers to the ability of a liquid to wet a surface: the higher the surface energy of a solid surface, the higher the wettability of the surface, and vice versa. Aperture plates are typically modified to have a low surface energy relative to the surface tension of the ink used in the imaging device (e.g., phase change ink heated to a liquid state) to limit the ability of the ink to wet, or adhere, to the aperture plate at least in the areas around the apertures. Thus, using previously known aperture plates, the waste ink emitted by the nozzles of the printhead flows rather quickly down the surface of the aperture plate.

In order to enhance the ability of the aperture plates of the present disclosure to recycle ink, aperture plates may be provided with a mixture of low and high surface energy areas to, for example, channel waste ink into specific areas on the aperture plate or even stall or slow the flow of ink down the plate to give the head time to recycle the ink. For example, referring to FIGS. 7 and 8, the area in the aperture plate 140 between the ink ejecting apertures 134 and the recycling apertures 150 may be modified to have a surface energy that is lower than the surface tension of the ink and higher than the surface energy of the aperture plate in the areas around the apertures 134. By providing a high surface energy area on the aperture plate between the ejecting apertures and the recycling apertures, waste ink that has been emitted by the apertures 134 is encouraged to collect in the high surface energy areas until enough ink mass has coalesced to enable the ink to flow past the high surface energy areas to the recycling apertures 150. Thus, high surface energy areas of the aperture plate 140 may be used to slow the flow of ink from the ejecting apertures 134 to the recycling apertures to increase the amount of time that the printhead has to recycle ink that has been collected, for example, in front of the recycling apertures by the cover plate 160.

In the embodiment of FIGS. 7 and 8, for example, a high surface energy area may be provided one or more strips that extend laterally across the aperture plate between the apertures 134 and the recycling apertures 150. Areas of the aperture plate may be modified to have a desired surface energy in any suitable manner as is known in the art. For example, in an aperture plate that has been provided with a low surface energy coating, such as polytetrafluoroethylene (Teflon), higher surface energy areas may be provided, for example, by masking desired areas during the polytetrafluoroethylene coating process.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A printhead for use in an imaging device, the printhead comprising:

a reservoir configured to receive ink from an ink source;

an aperture plate having a plurality of ink jet apertures at a first location in the aperture plate, and a plurality of apertures at a second location in the aperture plate;

a plurality of ink jets, each ink jet being configured to receive ink from the reservoir and to eject ink through one of the ink jet apertures in the plurality of ink jet apertures in the aperture plate;

a plurality of channels, each channel being configured to fluidly connect one of the apertures in the plurality of apertures at the second location in the aperture plate to the reservoir; and a pressure source coupled to the reservoir and configured to generate a pressure in the reservoir.

2. The printhead of claim 1, further comprising:

an aperture cover plate positioned on the aperture plate at the second location and configured to receive ink emitted by the plurality of ink jets through the plurality of ink jet apertures and hold the received ink at the plurality of apertures at the second location in the aperture plate.

3. The printhead of claim 2, the pressure source being configured to generate a negative pressure in the reservoir to cause the ink received by the aperture cover plate to be drawn through the plurality of apertures at the second location in the aperture plate and channels into the reservoir.

4. The printhead of claim 2, the apertures having a circular cross-sectional shape with a diameter between 38 μm and 42 μm.

5. The printhead of claim 1, the apertures in the aperture plate having the same size as the ink jet apertures in the aperture plate.

6. The printhead of claim 1, the first location being above the second location.

7. The printhead of claim 6, the aperture plate having a first surface energy in the first location, and at least a portion of an area of the aperture plate between the first location and the second location having a second surface energy, the second surface energy being greater than the first surface energy.

8. A printhead for use in an imaging device, the printhead comprising:

a reservoir configured to receive ink from an ink source;

an aperture plate having a plurality of ink jet apertures;

a jet stack including:

a plurality of ink jets at a first location in the jet stack, the jet stack being configured to receive ink from the reservoir and communicate the ink to the plurality of ink jets, the plurality of ink jets being configured to eject ink through the plurality of ink jet apertures in the aperture plate;

at least one recycle pocket formed at a second location in the jet stack and configured to capture ink emitted by the plurality of ink jets through the plurality of ink jet apertures and that moves along the aperture plate to the at least one recycle pocket;

a plurality of apertures formed in a wall of the at least one recycle pocket;

and a plurality of recycling channels extending through the jet stack to fluidly connect the plurality of apertures in the wall of the at least one recycle pocket to the reservoir; and a negative pressure source configured to apply a negative pressure to the reservoir to draw ink in the at least one recycle pocket through the plurality of recycling apertures and the recycling channels into the reservoir.

9. The printhead of claim 8, the apertures in the wall of the at least one recycle pocket having a size approximately equal to a size of the ink jet apertures in the aperture plate.

10. The printhead of claim 9, the plurality of the apertures in the wall of the recycle pocket having a density of 20 apertures per square inch.

11. The printhead of claim 10, the second location being below the first location on the aperture plate.

12. The printhead of claim 8, the aperture plate having a first surface energy in the first location, and at least a portion of an area of the aperture plate between the first location and the second location having a second surface energy, the second surface energy being greater than the first surface energy.

13. The printhead of claim 12, the second location being above the first location.

14. The printhead of claim 13, further comprising:

a wiper configured to move waste ink upward on the aperture plate from the first location to the second location.

15. The printhead of claim 8, the jet stack being formed of a plurality of stacked plates, the plurality of plates including openings that interact to form the plurality of ink jets, the at least one recycle pocket, the plurality of apertures, and the plurality of recycling channels.

16. An imaging device comprising:

an ink source configured to supply melted phase change ink;

at least one printhead including:

a reservoir configured to receive melted phase change ink from the ink source;

an aperture plate including a plurality of ink jet apertures at a first location in the aperture plate, and a plurality of apertures at a second location in the aperture plate;

a jet stack including a plurality of ink jets and a plurality of recycling channels, the jet stack being configured to receive ink from the reservoir and communicate the ink to the plurality of ink jets, the plurality of ink jets being configured to eject ink through the plurality of ink jet apertures in the aperture plate, the plurality of recycling channels extending through the jet stack to fluidly connect the plurality of apertures at the second location in the aperture plate to the reservoir; and a recycling aperture cover plate positioned on the aperture plate at the second location and configured to receive ink emitted by the plurality of ink jets through the plurality of ink jet apertures and hold the ink at the plurality of apertures; and a negative pressure source configured to apply a negative pressure to the reservoir to draw ink received by the recycling aperture cover plate through the plurality of apertures at the second location in the aperture plate and the plurality of recycling channels into the reservoir.

17. The imaging device of claim 16, the apertures at the second location in the aperture plate having a size that is approximately equal to the ink jet apertures in the aperture plate.

18. The imaging device of claim 17, the apertures at the second location in the aperture plate having a circular cross-sectional shape with a diameter between 38 μm and 42 μm.

19. The imaging device of claim 18, the plurality of apertures at the second location in the aperture plate having a density of 20 apertures per square inch.

20. The imaging device of claim 16, the jet stack being formed of a plurality of stacked plates, the plurality of plates including openings that form the plurality of ink jets and the plurality of recycling channels.

* * * * *